United States Patent [19]

Levine

[11] 4,428,607

[45] Jan. 31, 1984

[54] LATCHING ASSEMBLY

[75] Inventor: Harold H. Levine, Northridge, Calif.

[73] Assignee: Lockheed Corporation, Burbank, Calif.

[21] Appl. No.: 220,088

[22] Filed: Dec. 24, 1980

[51] Int. Cl.[3] ..... E05B 47/00

[52] U.S. Cl. ..... 292/201

[58] Field of Search ..... 292/201, 246, 144, 251.5, 292/229

[56] References Cited

U.S. PATENT DOCUMENTS

| | | | |
|---|---|---|---|
| 2,440,734 | 5/1948 | Burke | 292/246 X |
| 3,620,560 | 11/1971 | Peters | 292/201 |
| 3,635,511 | 1/1972 | Waller | 292/251.5 |
| 3,819,199 | 6/1974 | Smolka et al. | 292/251.5 X |
| 3,831,986 | 8/1974 | Kobayashi | 292/251.5 X |
| 3,860,277 | 1/1975 | Wang | 292/251.5 |
| 3,937,505 | 2/1976 | Dempsey | 292/201 |

*Primary Examiner*—Richard E. Moore
*Attorney, Agent, or Firm*—Frederic P. Smith

[57] ABSTRACT

A latching assembly comprising first and second mechanically engageable latch members (14,24), biasing means (60,62) for causing the latch members (14,24) to assume a disengaged position, a permanent magnet (50) for overcoming the force of the biasing means, the permanent magnet (50) being isolated from the latch members (14,24) when the latch members (14,24) are in an engaged position, and an electromagnet (46) having a polarity when energized opposing the permanent magnet (50) for overcoming the force thereof and thereby permitting the biasing means (60,62) to cause the latch members (14,24) to assume the disengaged, unlatched position. The assembly is also designed so that the biasing means (60,62) and the electromagnet (46) are isolated from the latch members (14,24) when the latch members (14,24) are in an engaged position.

16 Claims, 5 Drawing Figures

LATCHING ASSEMBLY

TECHNICAL FIELD

The invention relates to the field of latching assemblies and, in particular, to latching assemblies utilizing permanent magnets and electromagnets in the operation thereof.

BACKGROUND ART

Latching assemblies, and in particular magnetic latching assemblies, are in widespread use in modern aircraft for latching doors or closure panels on compartments containing oxygen equipment and masks and other emergency supplies for the passengers. In such magnetic latching assemblies, a permanent magnet is employed in maintaining the door in a closed or latched position and an electromagnet is used to cause the door to open or become in an unlatched position. Normally, the unlatching is accomplished by actuation of the electromagnet by the pilot of the aircraft. It has been found, however, that due to certain loading forces on the doors, the latching assemblies will either refuse to open when they are commanded to do so or will open automatically when they are not supposed to. These loading forces consist of flight loads due to twists of the airplane, vibration frequencies of different resonances between two mating parts, handling forces due to human causes, and gravitational loads caused by rapid aircraft acceleration or deceleration.

A latching assembly designed to overcome the above problems is shown in U.S. Pat. No. 3,635,511, entitled "Latching Assembly with Magnetic Latching", issued to H. A. Waller. In Waller, a first latching subassembly, including an electromagnet, is fastened to the inside surface of a compartment doorjamb and a second latching subassembly, including a latch lever and a permanent magnet latch bar mounted on the latch lever, is mounted adjacent the upper edge of the inside surface of the compartment door. When the latching assembly is closed, the permanent magnet mechanically engages the pole pieces of the first latching assembly and stays in position due to the magnetic attraction between itself and the metallic first latching assembly. Upon actuation of the electromagnet, the magnet and the latch to which it is coupled is repelled from the mechanical engagement and pivots out of latching position assisted by a spring. Thus, the permanent magnet both maintains or holds the latched position and acts as the mechanical latching engagement, until repelled by the electromagnet. Another latching assembly is shown in U.S. Pat. No. 3,860,277, entitled "Latching Assembly with Magnet Locking", issued to W. S. Wang. In a first embodiment of Wang, an electromagnet is positioned on the inside surface of a compartment top wall. A first latching lever, having a permanent magnet thereon, is pivotally mounted adjacent the electromagnet and coupled to the top wall. A second latch lever is mounted on a door and is biased open by a spring. The latch levers are held in mechanical engagement by the permanent magnet against the force of the bias spring. Upon activation of the electromagnet, the permanent magnet is repelled, causing the latch levers to unlatch. In a second embodiment, a spherical latch member or ball is held in mechanical engagement by a circumferentially spaced array of latch balls which are operable to engage the spherical latch member. A latch plunger which causes the latch balls to engage the spherical latch member is biased to a rearward unlatched position by a coil spring. The plunger is normally maintained in a forward latched position by means of a permanent magnet mounted on the plunger which attracts the poles of an electromagnet and overcomes the bias of the coil spring and a C-shaped spring which normally causes the latch balls to be in an expanded state. When the electromagnet is actuated, the force of the permanent magnet is overcome and the bias spring allows the latching assembly to unlatch.

Severe difficulties exist, however, with the latching assemblies of the above configurations. The door lever in Waller is directly loaded by the permanent magnet engaging the detent of the pole piece, causing a critical interface where the latch members meet with difficult tolerance controls. The inner latch members of Wang are also directly loaded by the permanent magnet, particularly in the first embodiment, again causing a critical interface where the latch members meet with difficult tolerance controls. It is apparent that poor quality control of the interfaces would inevitably lead to premature unlatching due to forces on the magnet or to lock-up due to excessive friction. In addition, in the second embodiment of Wang, any door loading would cause the spherical latch member to jam up against the latch balls and the latch plunger and prevent the electromagnet from unlatching the door since the bias spring is not strong enough to overcome the frictional forces between the spherical latch member, the latch balls and the latch plunger. Furthermore, any other types of loads on the door are directly transmitted to the permanent magnet, thereby increasing the probability of premature unlatchings.

Accordingly, it is a general object of the present invention to provide an improved latching assembly.

It is another object of the present invention to provide a latching assembly employing a permanent magnet which is not susceptible to premature unlatching or to lock-ups.

It is a further object of the present invention to provide a latching assembly which does not have critical interfaces.

It is still another object of the present invention to provide a latching assembly employing a permanent magnet in which the permanent magnet is disassociated from the latch members.

DISCLOSURE OF INVENTION

A latching assembly is provided. The latching assembly comprises first and second mechanically engageable latch members, biasing means for causing the latch members to assume a disengaged position, a permanent magnet for overcoming the force of the biasing means, the permanent magnet being isolated from the latch members when the latch members are in an engaged position, and an electromagnet having a polarity when energized opposing the permanent magnet for overcoming the force thereof and thereby permitting the biasing means to cause the latch members to assume the disengaged, ulatched position. The assembly is also designed so that the biasing means and the electromagnet are isolated from the latch members when the latch members are in an engaged position.

The novel features which are believed to be characteristic of the invention, both as to its organization and its method of operation, together with further objects and advantages thereof, will be better understood from the following description in connection with the accompanying drawings in which a presently preferred embodiment of the invention is illustrated by way of example. It is to be expressly understood, however, that the drawings are for purposes of illustration and description only and are not intended as a definition of the limits of the invention.

BEST MODE FOR CARRYING OUT THE INVENTION

Figure 1:
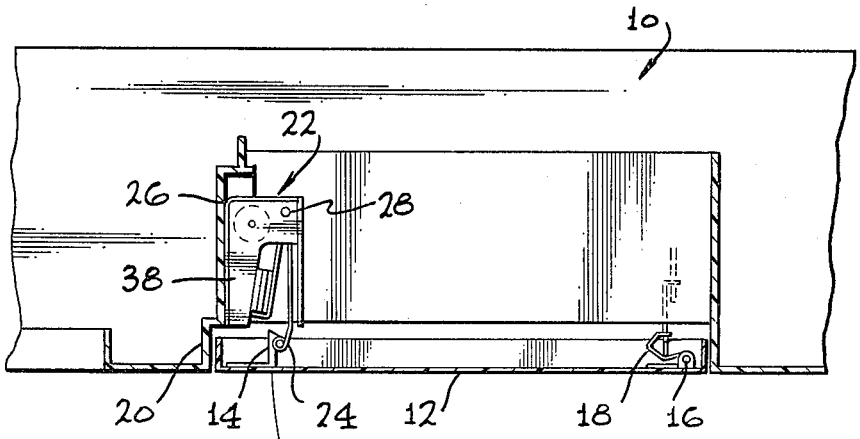
FIG. 1 is a cut-away view of a compartment showing the latching assembly of the present invention.

In FIG. 1 a cut-away view of a compartment showing the latching assembly of the present invention is illustrated. The compartment 10 has a door 12 that has mounted on it a latch lever 14. The door 12 pivots around point 16 and is spring loaded to a open position by spring 18. The compartment 10 has a doorjamb 20 upon which is mounted a latch assembly 22 containing a latch lever 24 which engages latch lever 14 to maintain the door 12 in a closed position.

Figure 2:
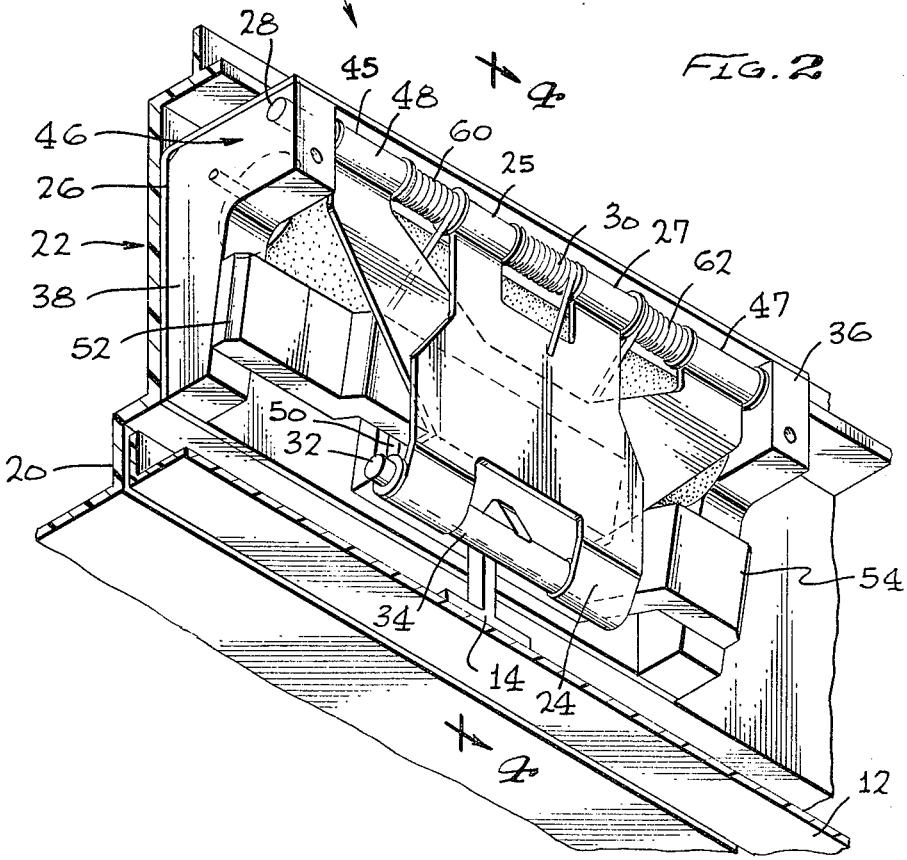
FIG. 2 is an perspective view of the latching assembly of the present invention.
Figure 3:
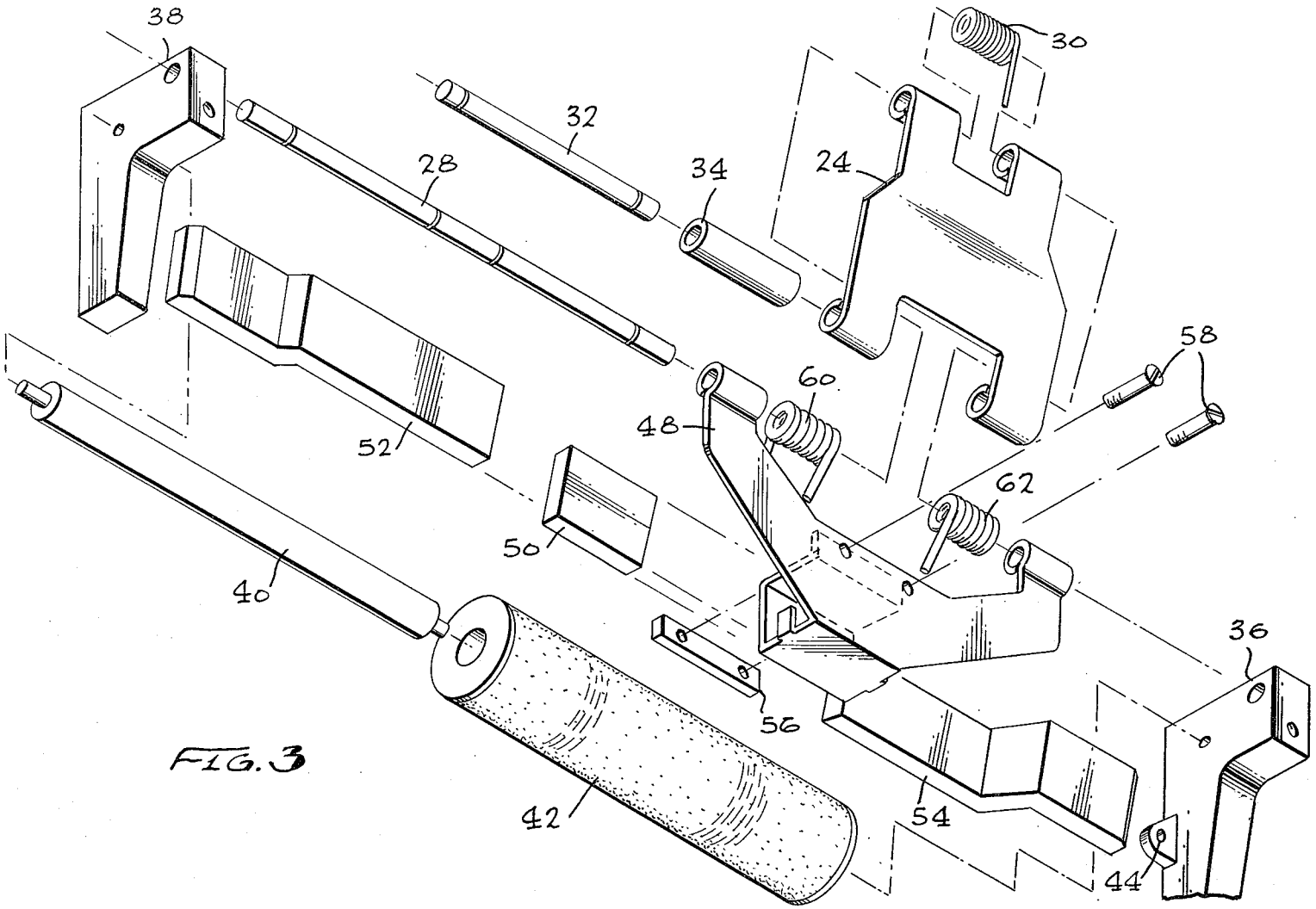
FIG. 3 is an exploded view of the latching assembly of FIG. 2.
Figure 4:
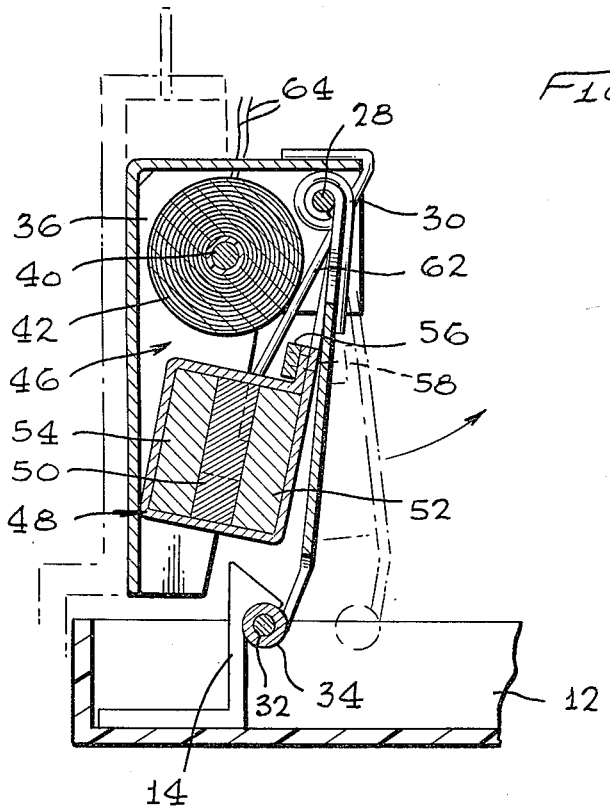
FIG. 4 is a cross-sectional view taken along the lines 4—4 of FIG. 2.

Referring now to FIGS. 2, 3 and 4, a perspective, exploded and cross-sectional view of the latch assembly 22 is illustrated. The latch assembly 22 has a housing 26 which surrounds the latch assembly 22 except in a portion thereof through which the latch lever 24 extends. The latch lever 24 is pivotally mounted on hinge points 25, 27 on an armature shaft 28 and is assisted in engaging the latch lever 14 by a bias spring 30 also mounted on the armature shaft 28. The latch lever 24 also includes a roller shaft 32 which supports a roller 34 which engages the latch lever 14. The armature shaft 28 is supported by a pair of electromagnet pole pieces 36, 38 which also support a iron core 40 and a coil 42 surrounding the iron core 40. The pole pieces 36, 38 are fastened through holes 44 to the doorjamb 20. The combination of pole pieces 36, 38, core 40 and coil 42 comprise the electromagnet, designated by numeral 46, which causes the latch levers 14, 24 to become disengaged. An armature support 48 is also pivotally mounted on hinge points 45, 47 on the armature shaft 28 which supports a permanent magnet 50 and a pair of pole pieces 52, 54. A nut strip 56 is used in conjunction with screws 58 and armature support 48 to contain the permanent magnet 50 and the pole pieces 52, 54 in an intimate supported relationship. Finally, a pair of bias springs 60, 62 are mounted on the armature shaft 28 and are coupled to the armature support 48 to urge it toward the latch lever 24.

In operation, when the door 12 is in the open position, the latch lever 24 is manually depressed in the direction of the pole pieces 36, 38 and consequently urges the armature support 48 towards the pole pieces 36, 38 until the pole pieces 52, 54 of the permanent magnet 50 come into contact with the pole pieces 36, 38 and magnetically hold the armature support 48 in position against the opposing forces of the springs 60, 62. The door 12 is then closed, with the bias spring 30 assisting the latch lever 24 to engage the latch lever 14. It should be noted that the bias spring 30 does not keep the door 12 closed or the latch levers 14, 24 together but only facilitates their engagement. The latch levers 14, 24 are kept in engagement mainly by the weight of the door 12, the force of the door spring 18, the weight of the contents pressing on the door 12, and the weight of the latch lever 14 on the door 12. The bias spring 30 is, however, useful for maintaining the engagement of the latch levers 14, 24 in the event of negative G forces. When it is desired to unlatch the door 12, the electromagnet 46 is actuated through wires 64 and, being of an opposing polarity to the permanent magnet 50, causes the pole pieces 36, 38 to overcome the attractive force of the pole pieces 52, 54 caused by the permanent magnet 50. Since the magnetic attractive force is substantially nullified, the bias springs 60, 62 cause the armature support 48 to pivot into contact with the latch lever 24 and disengage it from the latch lever 14. In a particular embodiment, the magnet 50 was designed to assert 7–10 pounds of attractive force, the bias springs 60, 62 were designed to assert 2–3 pounds of opposing force, while the electromagnet 46 was designed to reduce the attractive force of the magnet 50 to approximately 0.2 pounds. Thus even before the electromagnet 46 substantially nullified the force of the magnet 50, the bias springs 60, 62 would cause the armature support 48 to pivot towards the latch lever 24 and disengage the latch levers 14, 24. If desired, the electromagnet 46 could be designed to generate a net repulsive force on the pole pieces 52, 54 of the permanent magnet 50. In the particular embodiment, the magnet 50 consisted of samarium-cobalt and the minimum voltage applied to the coil 42 needed to cause the armature support 48 to rotate was 15.3 volts, with 23 volts being generally available in airplane circuitry. The bias spring 30 was designed to provided 0.25 pounds of return force for the latch lever 24.

It is thus seen that in the present invention, although the latching assembly is extremely compact, the permanent magnet is totally disassociated from the latch members and that the latching engagement is provided merely by the interaction of the latch levers 14, 24, with some assist being provided, when desired, from bias spring 30. Thus the actual mechanical engagement of the latch levers 14, 24 can be optimized independently of the electromagnetic circuit used for disengaging the latch assembly. In a like manner, the permanent magnet 50 and its associated pole pieces 52, 54 can be designed in conjunction with the electromagnet 46 and its associated pole pieces 36, 38 and the bias springs 60, 62 to optimize the holding force of the permanent magnet 50 so that the door 12 will not become unlatched until the combination of the opposing forces of the electromagnet 46 and the bias springs 60, 62 actually causes the door 12 to become unlatched and rotate into the open position. This total disassociation of the magnet 50 from the latch levers 14, 24 reduces significantly the problems of critical interfaces, frictional lock-up engagements and premature unlatching.

Figure 5:
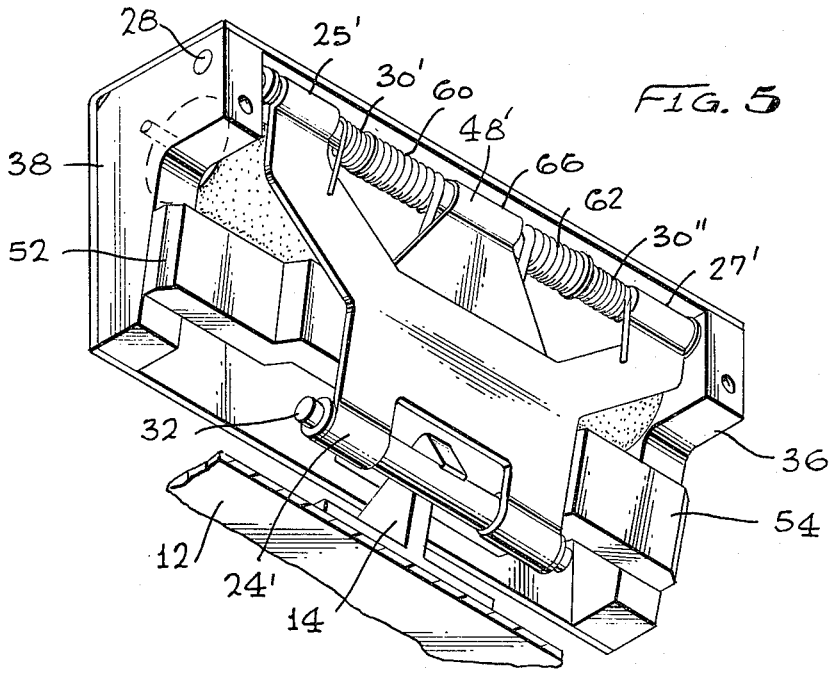
FIG. 5 is a perspective view of a second embodiment of the latching assembly of the present invention.

In FIG. 5, a second embodiment of the latching assembly of the present invention is illustrated. In this embodiment, the armature 48' is shown having one center hinge point 66 instead of two outer hinge points 45, 47 as shown in FIG. 2. The attachment of the armature support 48' to the armature shaft 28 by a single center hinge point 66 allows the armature 48' to flex and thus allows the pole pieces 52, 54 to better align with the pole pieces 36, 38, thereby reducing the size of the permanent magnet 50 needed to overcome the force of the bias springs 60, 62. As shown in FIG. 5, latch lever 24' has been reconfigured to have its hinge points 25', 27' astride the center hinge point 66 of armature 48' and to have two bias springs 30', 30''.

Having thus described the invention, it is obvious that numerous modifications and departures may by made by those skilled in the art; thus, the invention is to be construed to be limited only by the spirit and scope of the appended claims.

INDUSTRIAL APPLICABILITY

The latching assembly is useful for latching doors or closure panels on aircraft compartments.

I claim:

1. A latching assembly comprising:

a first latch member movable from an engaged position to a disengaged position;

a second latch member adapted to be mechanically engageable with said first latching member when said first latch member is in said engaged position;

a magnetic pole subassembly;

a magnetic armature subassembly, said magnetic armature subassembly being moveable relative to said magnetic pole subassembly and relative to said latch member from a first position wherein said armature subassembly completes a magnetic circuit across said magnetic pole subassembly to a second position wherein said magnetic armature subassembly is in contact with said first latch member;

biasing means for providing a bias force to said magnetic armature subassembly tending to cause said armature subassembly to move away from said magnetic pole subassembly and into contact with said first latch member and thereby to cause said first latch member to be moved to said disengaged position;

permanent magnetic means for applying an attractive magnetic force between said armature subassembly and said pole subassembly sufficient to overcome said bias force when said magnetic armature subassembly is in said first position in contact with said magnetic pole subassembly and said magnetic circuit is thereby completed; and electromagnetic means associated with said magnetic circuit and responsive to the application of an electrical voltage for reducing said magnetic attraction between said armature subassembly and said pole subassembly to the point where said biasing means will cause said armature subassembly to move into contact with said first latch member whereupon it will cause said first latch member to move to its said disengaged position wherein it will be disengaged from said second latch member.

2. The latching assembly of claim 1 wherein said biasing means is isolated from said first and second latch members when said first latch member is in said engaged position.

3. The latching assembly of claim 1 wherein said electromagnet means is isolated from said first and second latch members when said first latch member is in said engaged position.

4. The latching assembly of claim 1 further comprising second biasing means for assisting said first latch member to assume said engaged position.

5. The latching assembly of claim 1 wherein said second latch member is fixedly coupled to a door member.

6. The latching assembly of claim 1 wherein said second latch member is coupled to a door member and said first latch member is rotatably coupled to a doorjamb member.

7. The latching assembly of claim 6 wherein said magnetic armature subassembly is rotatably coupled to said doorjamb member and said biasing means rotatably urges said magnetic armature subassembly toward said second latch member to cause said first latch member to assume said disengaged position.

8. The latching assembly of claim 7 wherein said magnetic pole subassembly is fixedly coupled to said doorjamb means.

9. The latching assembly of claim 8 wherein said magnetic armature subassembly includes a pair of pole pieces coupling a permanent magnet therebetween, said pole pieces being configured to engage said magnetic pole subassembly.

10. The latching assembly of claim 7 further comprising shaft means coupled to said doorjamb means and rotatably supporting said first latch member and said magnetic armature subassembly.

11. The latching assembly of claim 10 wherein said shaft means supports said biasing means in engagement with said magnetic armature subassembly.

12. The latching assembly of claim 10 wherein said magnetic pole subassembly includes a pair of spaced pole pieces coupled to said doorjamb means and adapted to support said shaft means.

13. The latching assembly of claim 12 wherein said spaced pole pieces are coupled therebetween by elongated core means and annular electromagnetic coil means mounted thereon.

14. The latching assembly of claim 10 wherein said shaft means supports a second biasing means for assisting said first latch member to assume said engaged position, said second biasing means being supported in engagement with said first latch member.

15. The latching assembly of claim 1 wherein said first latch member includes roller means adapted to engage said second latch member.

16. The latching assembly of claim 1 wherein said electromagnet means is configured to repel said permanent magnet means.

* * * * *